United States Patent [19]

Stevens et al.

[11] 4,375,992

[45] Mar. 8, 1983

[54] APPARATUS AND METHOD FOR CLEANING RECORDED DISCS

[75] Inventors: Barry N. Stevens, Indianapolis; Lester R. Aldridge, Columbus, both of Ind.

[73] Assignee: RCA Corporation, New York, N.Y.

[21] Appl. No.: 370,533

[22] Filed: Apr. 21, 1982

Related U.S. Application Data

[63] Continuation of Ser. No. 220,126, Dec. 24, 1980, abandoned.

[51] Int. Cl.[3] ..... B08B 7/04

[52] U.S. Cl. ..... 134/25.4; 134/25.5; 134/32; 134/34; 134/60; 134/104

[58] Field of Search ..... 134/25.4, 25.5, 26, 134/32, 34, 60, 104; 210/776

[56] References Cited

U.S. PATENT DOCUMENTS

| | | | |
|---|---|---|---|
| 240,404 | 4/1981 | Gibbs . | |
| 1,545,979 | 7/1925 | Rosenberg . | |
| 2,580,420 | 1/1952 | Griswold et al. | 134/73 |
| 2,599,530 | 6/1952 | Hodges | 209/166 |
| 2,710,818 | 6/1955 | Winters | 134/18 |
| 2,845,077 | 7/1958 | Branson | 134/1 X |
| 2,923,648 | 2/1960 | K'Burg | 134/12 |
| 3,896,828 | 7/1975 | Foster et al. | 134/57 |
| 4,135,530 | 1/1979 | Cheney | 134/60 |

*Primary Examiner*—Marc L. Caroff

*Attorney, Agent, or Firm*—Birgit E. Morris; Donald S. Cohen

[57] ABSTRACT

In an apparatus for cleaning recorded discs wherein the discs are immersed into and removed from a cleaning liquid in a container, a flow of the liquid is provided substantially parallel to and slightly below the level of the liquid in the container across the area of the surface of the liquid through which the discs pass as they are removed from the liquid. The flow is provided by a plurality of nozzles located in the container slightly below the level of the liquid through which relatively clean liquid from the container is pumped. This flow is at a rate such as to remove from the area of the surface through which the discs are to pass contaminants which may float to the surface of the liquid.

11 Claims, 2 Drawing Figures

APPARATUS AND METHOD FOR CLEANING RECORDED DISCS

This is a continuation, of application Ser. No. 220,126, filed Dec. 24, 1980, now abandoned.

BACKGROUND OF THE INVENTION

The present invention relates to an apparatus and method for cleaning recorded discs and particularly to an apparatus and method for washing contaminating materials from the surfaces of the discs.

Recorded discs generally comprise a circular flat plate or disc of a plastic material having a center hole therethrough and recorded information provided thereon in the form of a surface relief pattern formed along a spiral path in the major surfaces of the disc. The surface relief patterns preferably are formed in a spiral groove in the surfaces of the disc. Recently there has been developed a high density recorded disc, such as a video disc, in which there ae a large number of grooves per inch of the diameter of the disc, e.g. 10,000 grooves per inch (4000 grooves per cm). Because of the large number of these grooves, they are very narrow and shallow, i.e. 2.7 microns in width and 4000 Angstroms in depth. Because of the fineness of these grooves, any contaminants, such as dirt, dust or other foreign particles, can severely disrupt the operation of the disc and their presence is therefore highly undesirable.

In order to remove contaminants from the surface of the discs, there has been developed a process wherein the discs are immersed in a cleaning solution, such as an aqueous solution of organic alcohol and amines of the type commercially available as 1160B from the Shipley Company, which removes the contaminants. The discs are then rinsed in water to remove the cleaning solution. To insure complete removal of the cleaning solution and contaminants, the discs are rinsed in several baths of the water, for example three baths. The first bath removes most of the cleaning solution, the second bath removes some of the remaining cleaning solution, and the final bath removes the remainder of the cleaning solution. Thus, the first bath becomes the dirtiest, containing a large amount of the removed cleaning solution and organic contaminants from the disc surface, the second bath is cleaner, and the third bath is the cleanest. To maintain this condition of the water baths, the water from the third bath overflows into the second bath and the water from the second bath overflows into the first bath. However, it has been found that the removed cleaning solution and disc material that is leached from its surface by water have a tendency to float to the surface of the baths and form a film thereof on the surface of the baths. Thus, when the discs are lifted out of the bath, some of the film will stick to the surfaces of the disc and recontaminate the discs. Therefore, it is desirable to have a rinsing bath in which the discs will not be recontaminated when removed from the bath.

SUMMARY OF THE INVENTION

A cleaning bath for recorded discs which includes a container for the cleaning liquid in which the discs are inserted and removed also includes means for removing from the area of the surface of the cleaning solution where the discs are to be removed from the solution any of the material cleaned from the disc which may float to the surface of the cleaning solution. The removing means includes means for directing a flow of the cleaning fluid along a path substantially parallel to and slightly below the level of the cleaning fluid in the container across the area of the surface of the cleaning fluid through which the discs pass when removed from the cleaning fluid.

DETAILED DESCRIPTION OF THE PREFERRED EMBODIMENT

Figure 1:
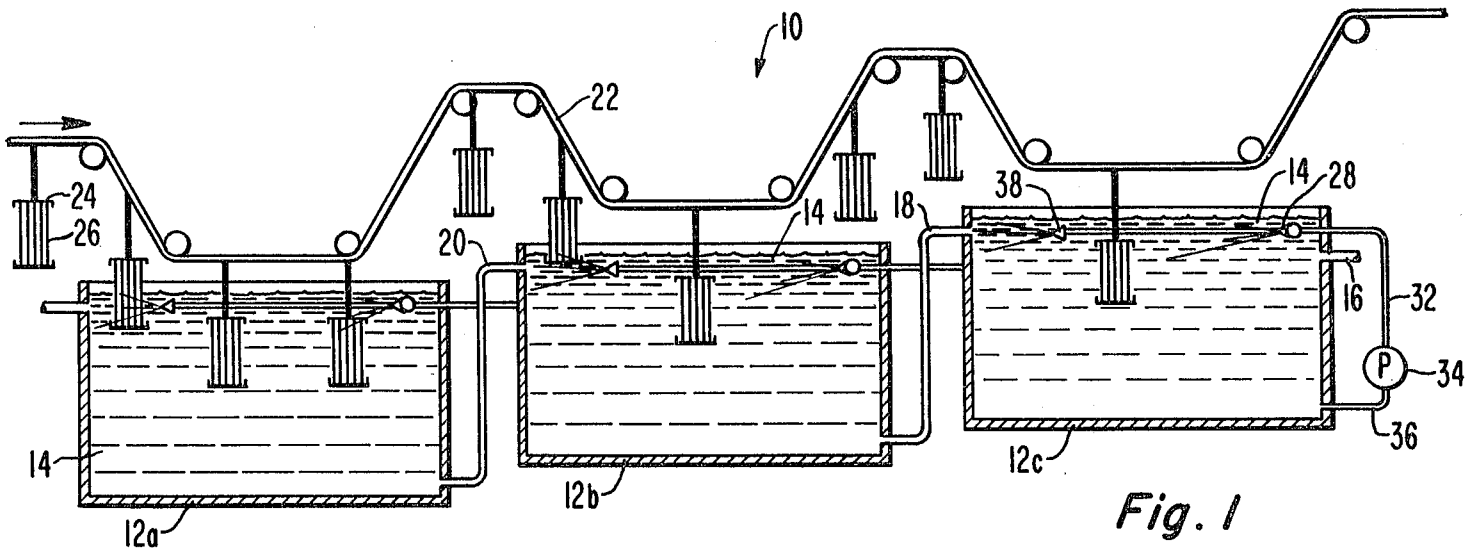
FIG. 1 is a schematic view of a cleaning apparatus which incorporates the present invention.

Referring initially to FIG. 1, a claning apparatus for video discs which incorporates the present invention is generally designated as 10. The cleaning apparatus includes a plurality of containers, for example three containers 12*a*, 12*b* and 12*c*. Each of the containers 12*a*, 12*b* and 12*c* is substantially identical in structure and each contains a rinsing liquid 14 such as water. The container 12*c* has an inlet pipe 16 through which fresh rinsing liquid is continuously admitted into the container. Overflow pipe 18 extends from the top of container 12*c* to container 12*b* whereby excess liquid will flow from the container 12*c* to the container 12*b*. An overflow pipe 20 extends from the top of container 12*b* to the container 12*a* whereby excess liquid will flow from the container 12*b* to the container 12*a*. Instead of using overflow pipes 18 and 20 to carry excess liquid from one of the containers to the next, the containers may be mounted directly against each other and at different levels so that the liquid will directly overflow from one container to the next.

Above the containers 12*a*, 12*b* and 12*c* is a conveyor 22 having racks 24 which contain the recorded discs 26 to be cleaned. The conveyor 22 is arranged to carry the racks 24 across first the container 12*a*, then the container 12*b* and finally over the container 12*c*. The conveyor 22 is also arranged so that as the racks 24 pass over a particular container the racks 24 and the discs 26 carried thereon are immersed into the liquid in the container at one end of the container (the entrance end), carried through the container and then removed from the liquid at the other end of the container (the exit end). Thus, the conveyor 22 is arranged to immerse each disc 26 first into the liquid 14 in the container 12*a*, then into the liquid 14 in the container 12*b* and finally in the liquid 14 in the container 12*c*. Prior to being immersed in the liquid in the various containers, the discs have been immersed in a cleaning solution of an aqueous solution, such as of organic alcohols and amines, to remove contaminants on the surface of the discs.

Figure 2:
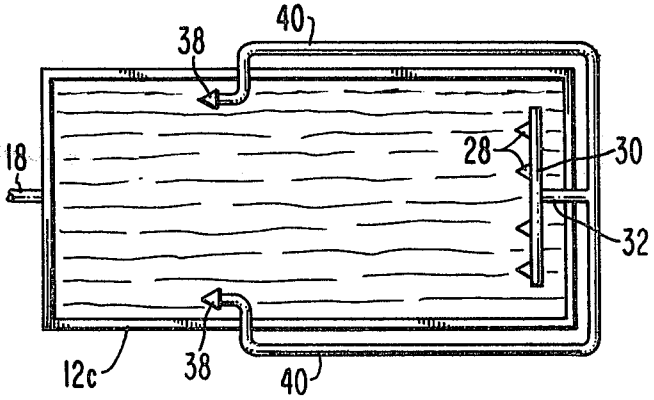
FIG. 2 is a top plan view of one of the cleaning tanks.

In each of the containers, such as the container 12*c* shown in FIG. 2, are a plurality of nozzles 28 connected to a manifold pipe 30. The nozzles 28 are positioned across the container 12*c* adjacent the exit end of the container and have the open ends directed towards the entrance end of the container. The nozzles 28 are positioned so they are slightly below the level of the liquid 14 in the container 12*c*, for example about one-half inch (1.27 cm) below the liquid level. A feed pipe 32 connects the manifold pipe 30 to a pump 34 as shown in FIG. 1. The inlet end of the pump is connected by a pipe 36 to the bottom of the container 12*c*. Thus, the pump 34 is adapted to draw liquid from the bottom of the container 12*c* and feed the liquid back into the container 12*c* through the nozzles 28. Auxiliary nozzles 38 are mounted in the container 12*c* adjacent the sides of the container and toward the entrance end of the container. The auxiliary nozzles 38 are also positioned slightly below the level of the liquid 14 and have their open ends facing toward the entrance end of the container 12*c*. The auxiliary nozzles 38 are connected by pipes 40 to the feed pipe 32.

During the operation of the cleaning apparatus 10, the pump 34 draws some of the cleaner liquid from the bottom of the container and forces the liquid out through the nozzles 28 and 38. The liquid emitted from the nozzles 28 results in a flow of liquid substantially parallel to and immediately below the surface of the liquid in the container across the area of the surface of the liquid in the container through which the discs 26 are removed from the container liquid. This flow of the liquid from the nozzles 28 moves any of the organic cleaning material which may float to the surface of the liquid 14 away from the exit area of the liquid toward the entrance end of the container. The flow from the auxiliary nozzles 38 helps continue the movement of any of the organic cleaning material or removed disc material toward the entrance end of the container where it can be removed from the particular container through the overflow pipe 18. This not only helps remove the organic material from the particular container to the next dirtier container, but more importantly it removes the organic material from the surface of the liquid in the area where the discs 26 are to be removed from the liquid. Thus, there is no contaminating material on the surface of the liquid in the container which can recontaminate the discs 26 as they are withdrawn from the liquid.

The position of the nozzles 28 below the surface of the liquid 14 is such as to create the necessary movement of any organic material on the surface of the liquid without creating too much turbulence or mixing at the surface of the liquid. As previously stated, this is achieved by having the nozzles 28 at a position of about one-half inch below the surface of the liquid. Also, the flow of the liquid from the nozzles 28 should be high enough to create the flow of liquid along the surface of the container liquid without causing too much turbulence which could cause mixing of the contaminants. It has been found that a flow of between 2 and 10 gallons per minute, preferably about 5 gallons per minute, will achieve the desired result. The flow of the rinsing liquid 14 from the inlet to the overflow outlet of each container is preferably about 11 gallons/minute for a container having therein about 350 gallons of rinsing liquid 14. Thus, there is provided an apparatus for rinsing the cleaning solution from the discs wherein the discs are thoroughly rinsed without recontaminating the discs as they are removed from the rinsing solutions.

What is claimed is:

1. In an apparatus for cleaning recorded discs which includes a container having a cleaning liquid therein into which the discs are inserted and removed, an inlet at one end of the container for admitting the cleaning liquid into the container and an overflow outlet at the other end of the container so as to provide a flow of the cleaning liquid from the inlet to the overflow outlet, and means for moving the discs through the liquid in the container toward said one end of the container, the improvement comprising means for directing an additional flow of the liquid toward said other end of the container along a path substantially parallel to and slightly below the level of the liquid in the container across the area of the surface of the liquid through which the discs pass when removed from the liquid.

2. An apparatus in accordance with claim 1 in which the means for directing the additional flow of the liquid includes a plurality of nozzles mounted in the container adjacent the inlet end and slightly below the liquid level and having their open ends facing the overflow end of the container.

3. An apparatus in accordance with claim 2 including a pump connected to the nozzles and to the container adjacent the bottom thereof so as to be capable of drawing liquid from the container and delivering the liquid to the nozzles.

4. An apparatus in accordance with claim 3 including a pair of auxiliary nozzles mounted in the container adjacent the sides of and near the other end of the container and slightly below the liquid level, the auxiliary nozzles having their open ends facing the other end of the container and being connected to the pump.

5. An apparatus in accordance with claim 3 including a plurality of these containers arranged in series, the overflow outlet of each container being connected to the inlet of the next adjacent container, the inlet of the container at one end being adapted to receive fresh liquid, each of said containers having a plurality of nozzles therein which are connected to a pump which has its inlet connected to the container adjacent the bottom of the container.

6. An apparatus in accordance with claim 5 including means for carrying discs to be cleaned from one container to the next and immersing the discs into each container adjacent the end having the overflow outlet and removing the discs from the container adjacent the nozzles.

7. In a method for cleaning a recorded disc in which the disc is submerged in and removed from a cleaning liquid in a container with the cleaning liquid being admitted into the container at one end thereof and overflowing out of the container at the other end thereof so that the cleaning liquid flows from the one end of the container to the other end, and in which the discs are moved through the liquid in the container toward said one end of the container, the improvement comprising providing an additional flow of the liquid along a path substantially parallel to and slightly below the surface of the cleaning liquid in a direction toward the other end of the container and across the area of the cleaning liquid through which the disc passes as it is removed from the cleaning liquid.

8. A method in accordance with claim 7 in which the additional flow is provided about one-half inch below the surface of the cleaning fluid.

9. A method in accordance with claim 8 in which the additional flow is at a rate of 2 to 10 gallons per minute.

10. A method in accordance with claim 9 in which the additional flow is at a rate of 5 gallons per minute.

11. In a method for cleaning recorded discs wherein the discs are immersed into and removed from cleaning liquid in a series of a plurality of containers in succession with the cleaning liquid flowing through each container and from one container to the next in a direction opposite to the movement of the discs so that the cleaning liquid in each container is cleaner than that in the previous container, the improvement comprising in each of the containers causing an additional flow of liquid in a direction opposite to the movement of the discs and substantially parallel to and slightly below the level of the cleaning liquid in the container across the area of the cleaning liquid through which the discs pass as they are removed from the cleaning liquid so as to remove from said area any contaminating material which may float to the surface of the cleaning liquid.

* * * * *